US006874318B1

(12) United States Patent
MacLeod

(10) Patent No.: US 6,874,318 B1
(45) Date of Patent: Apr. 5, 2005

(54) AUTOMATIC REMOTE PRESSURE COMPENSATION IN AN OPEN CIRCUIT PUMP

(75) Inventor: Ian J. C. MacLeod, Ames, IA (US)

(73) Assignee: Sauer-Danfoss, Inc., Ames, IA (US)

( * ) Notice: Subject to any disclaimer, the term of this patent is extended or adjusted under 35 U.S.C. 154(b) by 0 days.

(21) Appl. No.: 10/666,218

(22) Filed: Sep. 18, 2003

(51) Int. Cl.[7] ..... F16D 31/02
(52) U.S. Cl. ..... 60/451; 60/452
(58) Field of Search ..... 60/445, 451, 452

(56) References Cited

U.S. PATENT DOCUMENTS

| | | | | |
|---|---|---|---|---|
| 4,023,646 A | | 5/1977 | Heisig et al. | |
| 4,813,235 A | * | 3/1989 | Miller | 60/452 |
| 5,077,975 A | | 1/1992 | Kauss | |
| 5,085,051 A | | 2/1992 | Hirata | |
| 5,638,677 A | | 6/1997 | Hosono et al. | |
| 5,743,089 A | | 4/1998 | Tohji | |
| 6,033,188 A | | 3/2000 | Baldus et al. | |
| 6,282,892 B1 | | 9/2001 | Arai | |

FOREIGN PATENT DOCUMENTS

JP 405149276 A 6/1993

* cited by examiner

*Primary Examiner*—Thomas E. Lazo

(57) ABSTRACT

An open circuit system that uses a two-position three-way logic valve that automatically compensates for remote pressure in the system. The system has a pump that sends a pump supply through an orifice to the two-position three-way logic valve. Then depending on the load sense signal, the valve either allows the flow of the pump supply to the compensation relief valve or alternatively, the logic valve prevents the flow from the pump supply. The load sensing signal determines whether the valve will allow flow from the pump supply.

8 Claims, 2 Drawing Sheets

AUTOMATIC REMOTE PRESSURE COMPENSATION IN AN OPEN CIRCUIT PUMP

BACKGROUND OF THE INVENTION

This invention relates to an open circuit hydraulic system that has automatic remote pressure compensation. Many mobile hydraulic vehicles require an elevated pressure to operate circuits such as brakes, differential lock, and other such operational circuits. In some applications the elevated supply pressure is delivered by an individual pump. In yet alternative applications the elevated supply pressure is delivered by triggering an on/off solenoid in a remote pressure compensation circuit using an open circuit piston pump. These systems must overcome a remote pressure compensation function or supply a dedicated pump circuit using complex systems. To eliminate the complexity and/or cost of the individual pump and solenoid options, an automatic function is desired.

Thus, it is a primary object of the present invention to provide a means to supply an elevated pressure to an operational circuit that improves upon the state of the art.

Yet another object of the present invention is to reduce the complexity of overcoming a remote compensation pressure function or supplying a dedicated pump circuit.

A further object of the present invention is to eliminate the need for a solenoid operative valve or an additional pump to achieve a remote pressure compensation function.

Yet a further object of the present invention is to use a two-position three-way logic valve to overcome the remote pressure compensation function in an open circuit piston pump.

Yet a further object of the present invention is to provide a pump system that provides remote pressure compensation in addition to standard load sense functionality.

A further object of the present invention is to provide a pump that automatically switches between the functionality of remote pressure compensation and load sense with a new circuit.

These and other objects, features, or advantages of the present invention will become apparent from the specification and the claims.

BRIEF SUMMARY OF THE INVENTION

The present invention is an automatic remote pressure compensator in an open circuit. The system has a hydrostatic pump, a pressure compensator spool setting and a load sensor spool setting. This system integrates a two-position three-way logic valve that automatically shifts to stop fluid flow from a pump supply of fluid to a remote pressure compensation relief valve depending on the load sense pressure. When the load sense pressure is zero the two-position three-way logic valve delivers flow to the remote pressure compensation relief valve from the pump supply of fluid, and when the load sense pressure is above zero the two-position three-way logic valve does not allow flow from the pump supply of fluid to the pressure relief valve and a load sense signal defeats the relief valve.

DESCRIPTION OF THE PREFERRED EMBODIMENTS OF THE INVENTION

Figure 1:
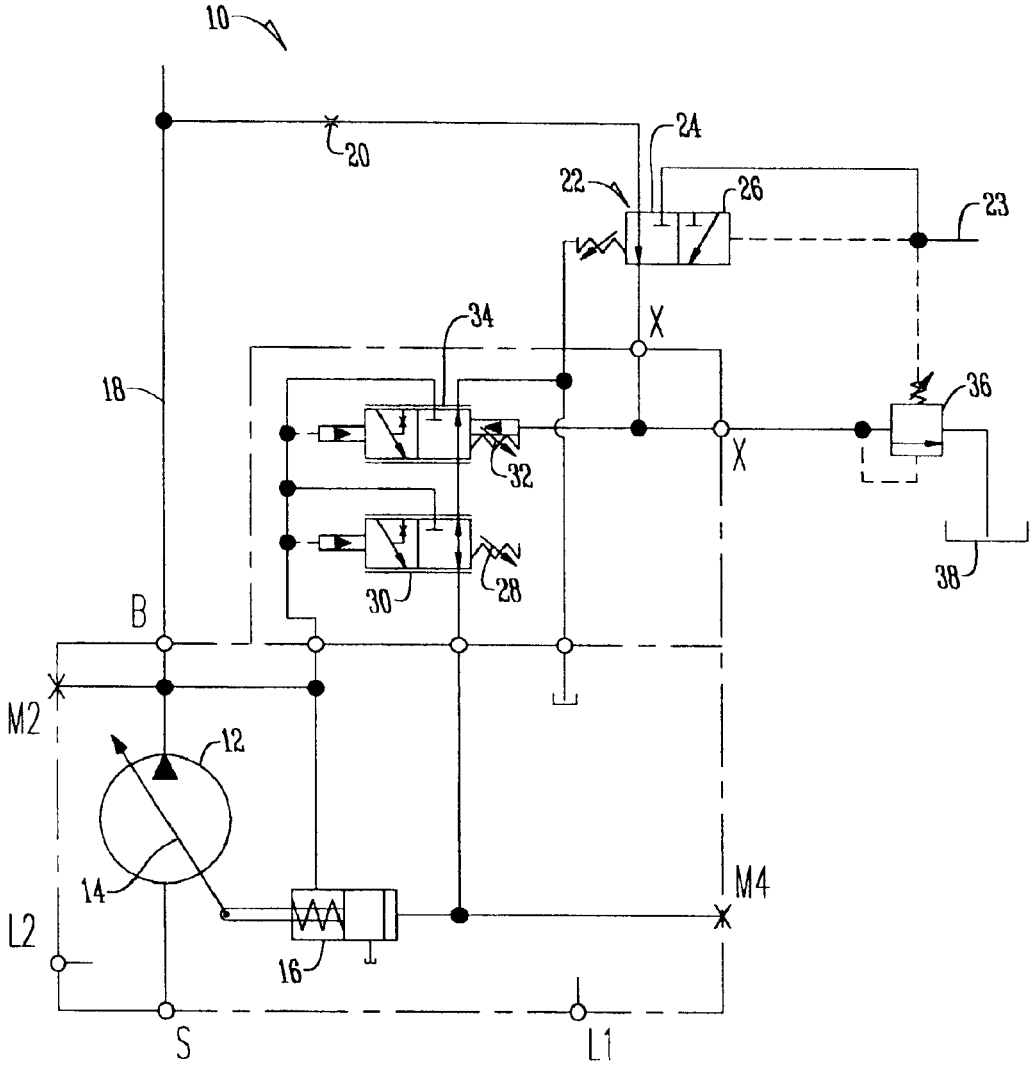
FIG. 1 is a schematic view of an automatic remote pressure compensator system wherein a two-position three-way logic valve is in a first position.
Figure 2:
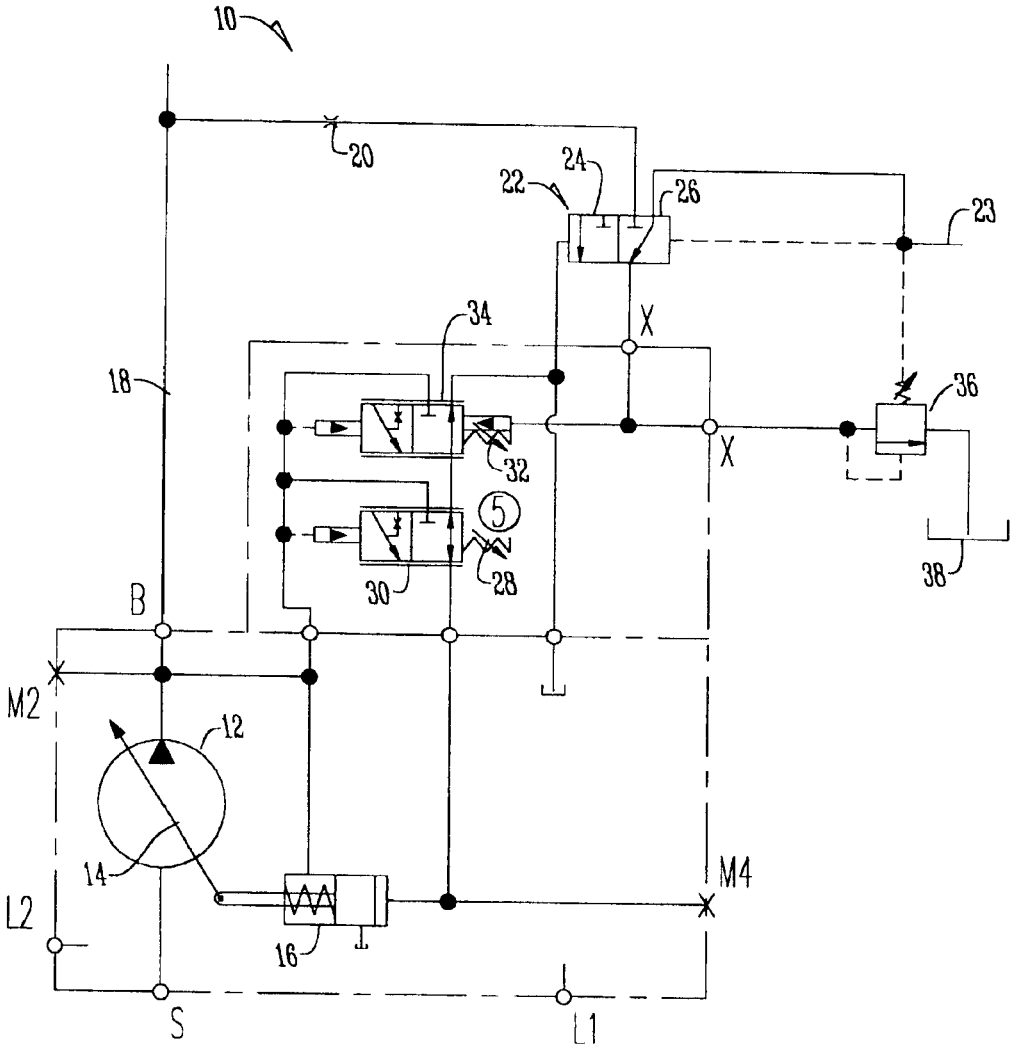
FIG. 2 is a schematic view of an automatic remote pressure compensator system wherein a two-position three-way logic valve is in a second position.

Automatic remote pressure compensation system 10 has a hydrostatic pump 12 with swashplate 14 that is controlled by a servo 16. The pump 12 produces a pump supply 18 that flows to orifice 20. The system 10 also has a two-position three-way logic valve 22 that receives a load sense signal 23 and has a first position 24 (FIG. 1) and a second position 26 (FIG. 2). The system also includes a pressure compensator spool setting 28 for the pressure compensating valve 30 and a load sense spool setting 32 for the pressure eliminating valve 34. Finally, the system also has a compensation relief valve 36 that is connected to a reservoir 38.

In operation, when the load sense pressure is zero, the logic valve 22 is spring biased to deliver flow from pump supply 18 across orifice 20 through the logic valve 22 and across remote compensation relief valve 36. This allows for remote pressure compensation functionality. The pump 12 supplies a pressure below the pressure of compensator spool setting 28, and above the load sense spool setting 32 pressure.

When the load sense signal is above zero, the logic valve 22 shifts from a first position 24 to a second position 26 blocking flow from the pump supply 18 and preventing the remote pressure compensation relief valve 36 from functioning by a signal line. Simultaneously, load sense signal 23 causes relief valve 36 to be defeated. Hence, when the logic valve 22 is in a shifted second position 26 the pump 12 operates as a traditional pressure compensation load sense open circuit pump.

System 10 decreases the load sense pressure only when an external load pressure is sensed, and is not dependent upon a change in pump displacement. The system 10 therefore provides dual functionality, both as a remote PC and a Load Sense pump without an external input to the system. The system 10 also allows for two fixed, discrete margin settings. Furthermore, system 10 is designed to reduce complexity and system costs, while achieving a remote pressure compensation and standard load sense functionality within the same pump.

It should be appreciated that the two-position three-way logic valve overcomes the remote pressure compensation function in the open circuit piston pump when a load signal is provided by the load sense line. This design also uses the automatic two-position three-way logic valve to reduce complexity in overcoming a remote pressure compensation function or supplying a dedicated pump circuit. The logic valve also allows the pump to automatically switch between the functionality of the remote pressure compensation and load sense within the circuit. Therefore, all of the objects of the present invention have been achieved.

It will be appreciated by those skilled in the art that other various modifications could be made to the device without the parting from the spirit in scope of this invention. All such modifications and changes fall within the scope of the claims and are intended to be covered thereby.

What is claimed is:

1. An open circuit hydrostatic transmission comprising:

a pump;

an orifice fluidly connected to the pump;

a two-position three-way logic valve having a first and second position fluidly connected to the orifice; and a remote pressure compensation relief valve adapted to receive a load sense signal and fluidly connected to the orifice and to the two-position three-way logic valve when the two-position three-way logic valve is in the first position.

2. The open circuit hydrostatic transmission of claim 1 wherein the remote pressure compensation relief valve is not fluidly connected to the orifice when the two-position three-way logic valve is in the second position.

3. The open circuit hydrostatic transmission of claim 2 wherein a load sense signal defeats the remote pressure compensation relief valve when the two-position three-way logic valve is in the second position.

4. The open circuit hydrostatic transmission of claim 2 further comprising a pressure compensator spool valve having a spool setting pressure fluidly connected to the pump;

and a pressure limiting valve having a load sense spool setting pressure fluidly connected to the pressure compensator spool valve and fluidly connected to the remote pressure compensation relief valve.

5. The open circuit hydrostatic transmission of claim 4 wherein the pump has a pressure below the compensator spool setting pressure and above the load sense spool setting pressure.

6. An open circuit hydrostatic transmission comprising:

a pump;

an orifice fluidly connected to the pump;

a two-position three-way logic valve having a first and second position fluidly connected to the orifice and adapted to receive a load sensing signal;

said two-position three-way logic valve adapted to be in the first position when the load sensing signal is zero and the second position when the load sensing signal is above zero; and a remote pressure compensation relief valve adapted to receive a load sensing signal fluidly connected to the orifice when the two-position three-way logic valve is in the first position and disconnected from the orifice when the two-position three-way logic valve is in the second position.

7. The open circuit hydrostatic transmission of claim 6 wherein a load sensing signal defeats the remote pressure compensation relief valve when the two-position three-way logic valve is in the second position.

8. The open circuit hydrostatic transmission of claim 6 further comprising a pressure compensator spool valve having a spool setting pressure fluidly connected to the pump; and a pressure limiting valve having a load sense spool setting pressure fluidly connected to the pressure compensator spool valve and fluidly connected to the remote pressure compensation relief valve.

* * * * *